US009452108B2

(12) United States Patent
Ariagno et al.

(10) Patent No.: US 9,452,108 B2
(45) Date of Patent: Sep. 27, 2016

(54) DEVICE FOR ENCOURAGING ADHERENCE TO MEDICATION SCHEDULE AND PROPER ADMINISTRATION TECHNIQUE

(71) Applicants: Baxter International Inc., Deerfield, IL (US); Baxter Healthcare S.A., Glattpark (Opfikon) (CH)

(72) Inventors: Scott Ariagno, Palatine, IL (US); Daniel E. Roush, Niles, IL (US)

(73) Assignees: BAXALTA INCORPORATED, Bannockburn, IL (US); BAXALTA GMBH, Glattpark (Opfikon) (CH)

( * ) Notice: Subject to any disclaimer, the term of this patent is extended or adjusted under 35 U.S.C. 154(b) by 107 days.

(21) Appl. No.: 14/464,118

(22) Filed: Aug. 20, 2014

(65) Prior Publication Data

US 2015/0053711 A1 Feb. 26, 2015

Related U.S. Application Data

(60) Provisional application No. 61/867,856, filed on Aug. 20, 2013.

(51) Int. Cl.

| | |
|---|---|
| ***G04B 47/00*** | (2006.01) |
| ***A61J 7/04*** | (2006.01) |
| *A61J 1/20* | (2006.01) |

(52) U.S. Cl.

CPC ..... *A61J 7/0409* (2013.01); *A61J 1/2089* (2013.01); *A61J 7/0427* (2015.05); *A61J 7/0436* (2015.05)

(58) Field of Classification Search

CPC ..... A61J 7/0409

USPC ..... 340/309.16, 309.7, 539.29

See application file for complete search history.

(56) References Cited

U.S. PATENT DOCUMENTS

| | | | |
|---|---|---|---|
| 4,361,408 | A | 11/1982 | Wirtschafter |
| 4,419,016 | A | 12/1983 | Zoltan |
| 4,975,824 | A | 12/1990 | Huss et al. |
| 5,170,380 | A | 12/1992 | Howard et al. |
| 5,229,981 | A | 7/1993 | Maschi |
| 5,554,967 | A | 9/1996 | Cook et al. |
| 5,642,731 | A | 7/1997 | Kehr |
| 5,827,180 | A | 10/1998 | Goodman |

(Continued)

FOREIGN PATENT DOCUMENTS

DE 202009010135 12/2009

OTHER PUBLICATIONS

International Search Report from Corresponding PCT application PCT/US2014/051716 dated Nov. 19, 2014.

*Primary Examiner* — Brent Swarthout

(74) *Attorney, Agent, or Firm* — Greer, Burns & Crain, Ltd.

(57) ABSTRACT

A method of using a device for encouraging adherence to a medication schedule and proper administration technique includes placing the device on a surface. The device includes a body, a timer associated with the body for measuring and displaying an elapsed time since an immediately prior medication dose was administered; and a button on the body that, when depressed relative to the body, resets the timer. The button is sized and shaped for accommodating a medication container used to store or activate the medication. The button and the body are configured for cooperating with the medication container for facilitating mixing of the medication. The method further includes engaging the medication container with the button and resetting the timer.

18 Claims, 5 Drawing Sheets

(56) References Cited

U.S. PATENT DOCUMENTS

| | | | | |
|---|---|---|---|---|
| 6,101,452 | A * | 8/2000 | Krall et al. | 702/55 |
| 6,560,165 | B1 | 5/2003 | Barker | |
| 6,839,305 | B2 | 1/2005 | Perlman et al. | |
| 7,196,619 | B2 | 3/2007 | Perlman et al. | |
| 7,330,101 | B2 | 2/2008 | Sekura | |
| 7,397,730 | B2 | 7/2008 | Skyggebjerg et al. | |
| 7,944,342 | B2 | 5/2011 | Sekura | |
| 8,545,476 | B2 | 10/2013 | Ariagno et al. | |
| 8,734,420 | B2 | 5/2014 | Ariagno et al. | |
| 2006/0109750 | A1 | 5/2006 | McCracken et al. | |
| 2007/0091726 | A1 | 4/2007 | Stauffer et al. | |
| 2007/0170194 | A1 | 7/2007 | Leifeld | |
| 2011/0193705 | A1 | 8/2011 | Sekura | |
| 2012/0006708 | A1 | 1/2012 | Mazur | |
| 2012/0053555 | A1 | 3/2012 | Ariagno et al. | |
| 2012/0116196 | A1 | 5/2012 | Tubb | |
| 2012/0257478 | A1 | 10/2012 | Marcellino | |
| 2013/0204227 | A1 | 8/2013 | Bochenko et al. | |

* cited by examiner

DEVICE FOR ENCOURAGING ADHERENCE TO MEDICATION SCHEDULE AND PROPER ADMINISTRATION TECHNIQUE

RELATED APPLICATION

This application claims priority under 35 USC 119(e) from U.S. Provisional Application Ser. No. 61/867,856 filed Aug. 20, 2013.

BACKGROUND

The present invention relates to a device and system for tracking medical events, more particularly for tracking both time elapsed since a medication dosage was administered and time elapsed since one or more symptoms were noted by the patient.

Chronic illnesses may require regular medical treatments, as well as close monitoring of the condition. For example, a hemophiliac may require one or more medications to be administered on a regular basis, such as every several hours, once per day, once per week, etc. It would be impractical and expensive for the patient to schedule visits with a health care professional for each medication administration. Accordingly, patients typically self-administer these regimented medications. Adherence to the medication schedule is typically an important aspect of treatment.

Further, some medications are volatile. To help provide medications with an increased shelf life, they are provided to the patient or caregiver in a deactivated state. Prior to administration, the medication is activated. If the activation is performed incorrectly, the medication may be less effective than intended. Accordingly, patients are conventionally encouraged to correctly follow activation procedures for any prescribed medications. Suitable medicinal reconstitution devices for such application are disclosed in U.S. Pat. Nos. 8,734,420 and 8,545,476, both of which are incorporated by reference.

Moreover, treatment for some chronic diseases may be based on the presence or absence of particular symptoms. For example, a medication dosage for a hemophiliac patient may be increased if the patient's annual bleed rate exceeds a certain threshold. Moreover, such symptom tracking may help the patient and/or practitioner identify conditions which trigger the symptoms. Such information may prove valuable in further defining treatments for the patient.

Thus, there is a need to encourage patients to adhere to administration instructions for medications, including both scheduling and activation of the treatment. Additionally, there is a need to encourage patients to more accurately track their symptoms.

SUMMARY

A device for encouraging adherence to a medication schedule and proper administration technique addresses these needs. The device allows for tracking of time since a last medication dose was administered, as well as tracking time since a particular symptom was experienced by the patient. Further, use of the device facilitates proper administration technique of the medication. In addition, the present device motivates the user to set and achieve desired therapeutic outcome, and provides positive reinforcement of therapeutic techniques.

In a first aspect, a method of using a device for encouraging adherence to a medication schedule and proper administration technique is provided, the method including placing the device on a surface. The device has a body, a timer associated with the body for measuring and displaying an elapsed time since an immediately prior medication dose was administered, and a button on the body that, when depressed relative to the body, resets the timer. The button is sized and shaped for accommodating a medication container used to store or activate the medication. The button and the body are configured for cooperating with the medication container for facilitating mixing of the medication. The method further includes a step of engaging the medication container with the button and resetting the timer.

In another aspect, a device for encouraging adherence to a medication schedule and proper administration technique is provided and includes a body, a timer associated with the body for measuring and displaying an elapsed time since an immediately prior medication dose was administered; and a button on the body that, when depressed relative to the body, resets the timer, the button being sized and shaped for accommodating a medication container used to store or activate the medication. The button and the body are configured for cooperating with the medication container for facilitating mixing of the medication.

In yet another aspect, a device for encouraging adherence to a medication schedule and proper administration technique is provided and includes a microprocessor configured for generating a clock signal. A first timer receives the clock signal from the microprocessor as an input, and is configured for measuring a time elapsed since an immediately prior medication dose was administered on the basis of the input clock signal. A second timer receives the clock signal from the microprocessor as an input and is configured for measuring a time since a particular symptom presented in a user on the basis of the input clock signal. A first button, when activated, resets the first timer. The first button is sized and shaped to accommodate a medication container used to store or activate the medication, wherein the first button is constructed and arranged for cooperating with the medication container for mixing the medication. A second button resets the second timer.

In still another embodiment, a medication administering system is provided and includes a medication container including a plurality of components held separated by the container, and a device for encouraging adherence to a medication schedule and proper administration technique. Included in the device is a body, a timer associated with the body for measuring and displaying an elapsed time since an immediately prior medication dose was administered, and a button on the body that, when depressed relative to the body, resets the timer, the button being sized and shaped for accommodating the medication container used to store or activate the medication. The medication container is used to depress the button, thereby allowing mechanical breach of partitions separating the components.

DETAILED DESCRIPTION

Figure 1:
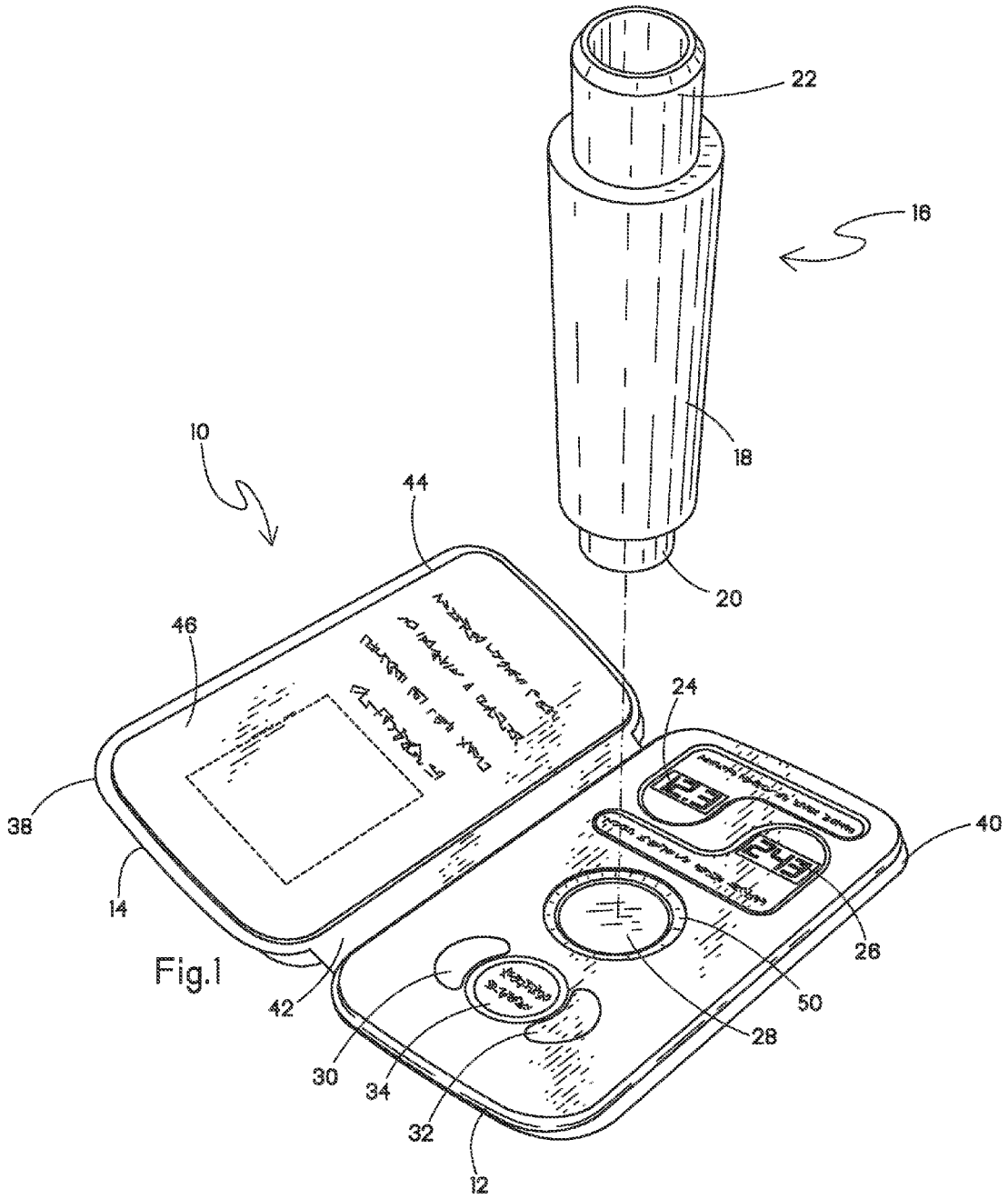
FIG. 1 is a top perspective view of an embodiment of the present device including a medication dispenser shown in exploded orientation relative to the device.
Figure 2:
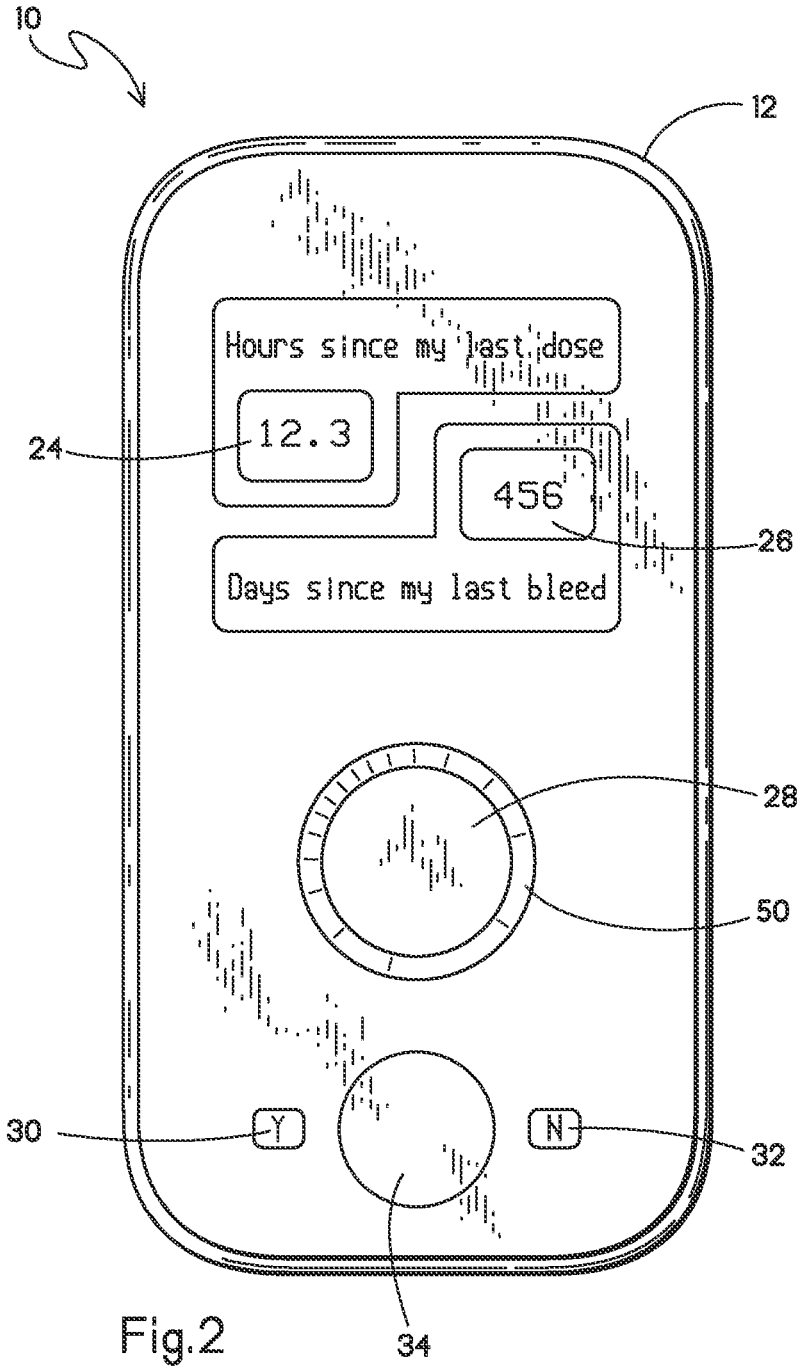
FIG. 2 is a front view of an alternate embodiment of the present device FIG. 1 shown without a cover.

Referring now to FIGS. 1 and 2, a device for encouraging patient compliance with a medication schedule and administration technique is generally designated 10. In particular, the device shown in FIGS. 1 and 2 is intended to encourage patient compliance with a medication schedule and administration technique for a hemophilia medication. However, those of skill in the art will recognize that the device has applications for other types of prescription and/or over the counter medications.

The device 10 includes a main body 12 and, optionally, a cover 14. The main body 12 and cover 14 are preferably formed from a light weight, low cost, durable material such as a thermoplastic resin, polycarbonate, or the like. The body 12 is sized and shaped to be easily portable by the user. As non-limiting examples, the body 12 is optionally approximately the same size and shape as a mobile phone or personal digital assistant, a key fob, or a utility knife. Alternatively, the body 12 may be formed in other useful shapes, such as a lid sized to fit a prescription pill bottle.

It is contemplated that the device 10 is used by a patient who routinely uses a medication provided in a dispensing container 16. A suitable container, also referred to as a reconstitution device, is disclosed in U.S. Pat. Nos. 8,734,420 and 8,545,476, both of which are incorporated by reference. Generally, the dispensing container 16 includes a main housing 18 retaining in a first end a first container or vial 20 of a first medicine or composition 20, and at an opposite end a second container or vial 22 of a second medicine or composition. Certain drugs are supplied in lyophilized form. It is customary that a lyophilized drug is mixed with water or other diluent or carrier solution to reconstitute the drug into a form suitable for injection into a patient. The dispensing container 16 is configured for retaining two compositions, each in one of the two vials 20 and 22, physically separated until use.

Figure 3:
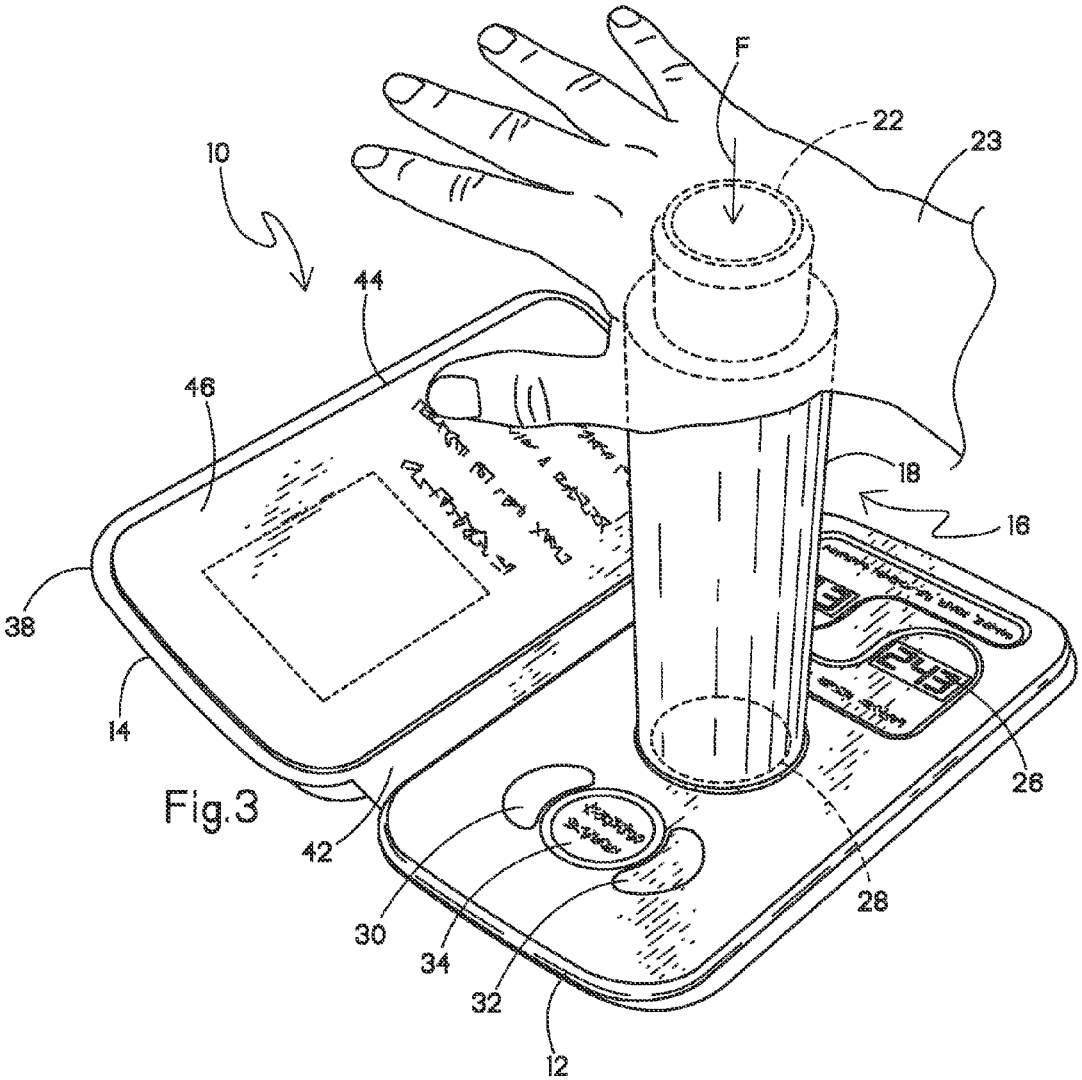
FIG. 3 is a perspective view of an embodiment of the device of FIG. 1, showing the device in use.

As best shown in FIG. 3, just prior to use of the medication, the user or a medical caregiver 23 causes the first and second vials 20 and 22 to move towards each other relative to the main housing 18 by placing the device 10 onto a surface and exerting a force F on the dispensing container 16, urging the container toward the device. The surface on which the device 10 is placed is preferably relatively flat and stable. Example surfaces suitable for this purpose include a table, a counter, a shelf, or the like. Structures (not shown) within the main housing 18 cause rupturing of respective seals of each of the vials 20, 22 and the subsequent controlled, sterile mixing of the contents so that the medicine is suitably formulated for injection into the patient.

It will be seen that the vials, 20, 22 each have a diameter smaller than a diameter of the main housing 18. The dispenser 16 is configured so that a first impact causes the first vial 20 to move upward as shown in FIGS. 1 and 3 relative to the main housing 18, and a second impact causes the second vial 22 to move downward as seen in FIGS. 1 and 3 towards the first vial. The first and second impacts can occur simultaneously.

Referring again to the device 10, disposed on the main body 12 is a first display 24 that shows a time since a last medication dose was administered and a second display 26 that shows a time since a particular symptom was last experienced by the patient. The main body 12 further includes an activation button 28 used to indicate that the patient has administered a medication dosage, and first and second symptom indicator buttons 30, 32 used to indicate, update and or reset an indication of the presence or absence of a particular symptom. A symptom indicator 34 is associated with the buttons 30, 32 to instruct the user about the purpose of those buttons, and may optionally include a backlit or flashing indicator 36.

Referring now to FIG. 1, the cover 14 preferably includes a protective portion 38 and an attachment portion 40 joined by a hinge portion 42. The protective portion 38 is generally planar and preferably has approximately the same size and shape as the body 12. However, it is contemplated that the size and shape of the protective portion 38 may vary. For example, the protective portion 38 is alternately and optionally configured for securely retaining and covering at least a portion of the main body 12 that includes the activation button 28 and the symptom indicator buttons 30, 32, but not the first and second displays 24, 26.

The attachment portion 40 releasably affixes the cover 14 to the body 12 using mating tabs, snaps, hook-and-loop fastening material, retaining loops, magnets, threaded fasteners, and/or other similar fastening technologies used in mobile phone or e-book reader or tablet covers. More permanent fastening, as by chemical adhesives, is also contemplated. As shown in FIG. 1, the protective portion 38 preferably includes a recess or pocket 44 that releasably retains a printed leaflet 46. In one embodiment, cover 14 could be replaceable such that a user can customize color, graphics, or appearance of the device 10 to suit needs and tastes.

The leaflet 46 may include information such as directions for administration of a drug, directions for use of the device 10, a log for noting the date and time of each medication dose administered, one or more pages for cataloging medication doses using a sticker from the medication packaging, information regarding the effects of the medication prescribed to the user, an area for the user to log treatment goals, an area for handwritten notes, and/or other information which may be useful to the user. Alternatively, the information is optionally printed directly onto the protective portion 38 and/or the attachment portion 40.

As discussed previously, the main body 12 is preferably sized and shaped to be similar to a mobile phone. The main body 12 surrounds a power source (not shown) and a logic board 48. Additionally, the main body 12 includes label text associated with each of the first and second displays 24 and 26. For example, label text associated with the first display may indicate "hours since my last dose" or the like. Similarly, label text for the second display indicates time period since the user's last symptom presentation. As a non-limiting example, when the device 10 is used to track a hemophilia patient, the label for the second display may read "days since my last bleed." Those of skill in the art will recognize that the label text for both the first and second displays 24, 26 may be altered to suit the situation. In particular, the units of time used in the label text may be altered. First label text may indicate that the time unit is, for example, minutes, hours, days, or weeks, depending upon how often the medication is to be administered. Similarly, the time units for the second display may be, for example, days, weeks, or months.

Referring now to FIGS. 1 and 2, the activation button 28 is disposed on the main body 12, and is preferably sized and shaped for accommodating and engaging the medication container/dispenser 16. That is, the size and shape of the activation button 28 are determined by the particular medication to be used in conjunction with the device 10. Preferably, the activation button 28 has a slightly recessed or concave exterior relative to a planar face of the main body 12, and the portion of the body immediately surrounding the activator button optionally includes a beveled edge or ring 50 for facilitating location and engagement of the medication container 16 upon the activator button. More specifically, it is preferred that the activation button 28 is sized and shaped so that the first vial 20 nests into the recessed area. The medication can be reconstituted by the user pushing down on the second vial 22, which also pushes the dispenser 16 and the first vial 20 against the button 28, with the body 12 serving as a stabilization base. This movement causes the button 28 to be depressed relative to the body 12, and also causes the vials 20, 22 to be retracted into the housing 18 for mixing of the respective components of the two vials. Alternatively, the activation button 28 may be depressed by a user as a separate act upon activation and administration of a medication dose. The activation button 28 and/or the attachment portion 40 are preferably formed with a resilient surface, such as a rubber-like compound or plastic to provide a non-slip surface that is pleasant to the touch and that facilitates secure engagement of the vial 20, and/or secure placement of the device 10 on a surface.

The symptom indicator buttons 30, 32 are designed to be activated by the user to indicate, update and/or reset the presence or absence of a particular symptom. The specific configuration of the buttons 30, 32 may vary to suit the situation, and it will be seen that the shape and positioning of these buttons vary between the embodiments of FIGS. 1 and 2. For example, in the case of a device for use with hemophilia medication, the buttons 30, 32 are optionally used to indicate whether the user has been bleed-free, as shown in FIGS. 1 and 2. The buttons 30, 32 are intended to be used as an indicator at each medication activation/dosing, but may be used more or less frequently, as desired by the user and/or indicated by a medical practitioner. The first and second symptom indicator buttons 30, 32 are preferably sized for easy depression or activation by a user, and are preferably provided with a resilient, non-slip surface as is known in the art. The symptom indicator 34 is preferably located near the buttons 30, 32 on the body 12 to provide the user with context for selecting a button. Additionally, the buttons 30, 32 are preferably labeled to aid the user in button selection. As a non-limiting example, FIGS. 1 and 2 show the text label "Bleed Free?" as the symptom indicator 34 on the body 12, with the first indicator button 30 including the text label "Y" and the second symptom indicator button 32 including the text label "N". Depressing the button 32 will reset the respective counter.

Figure 4:
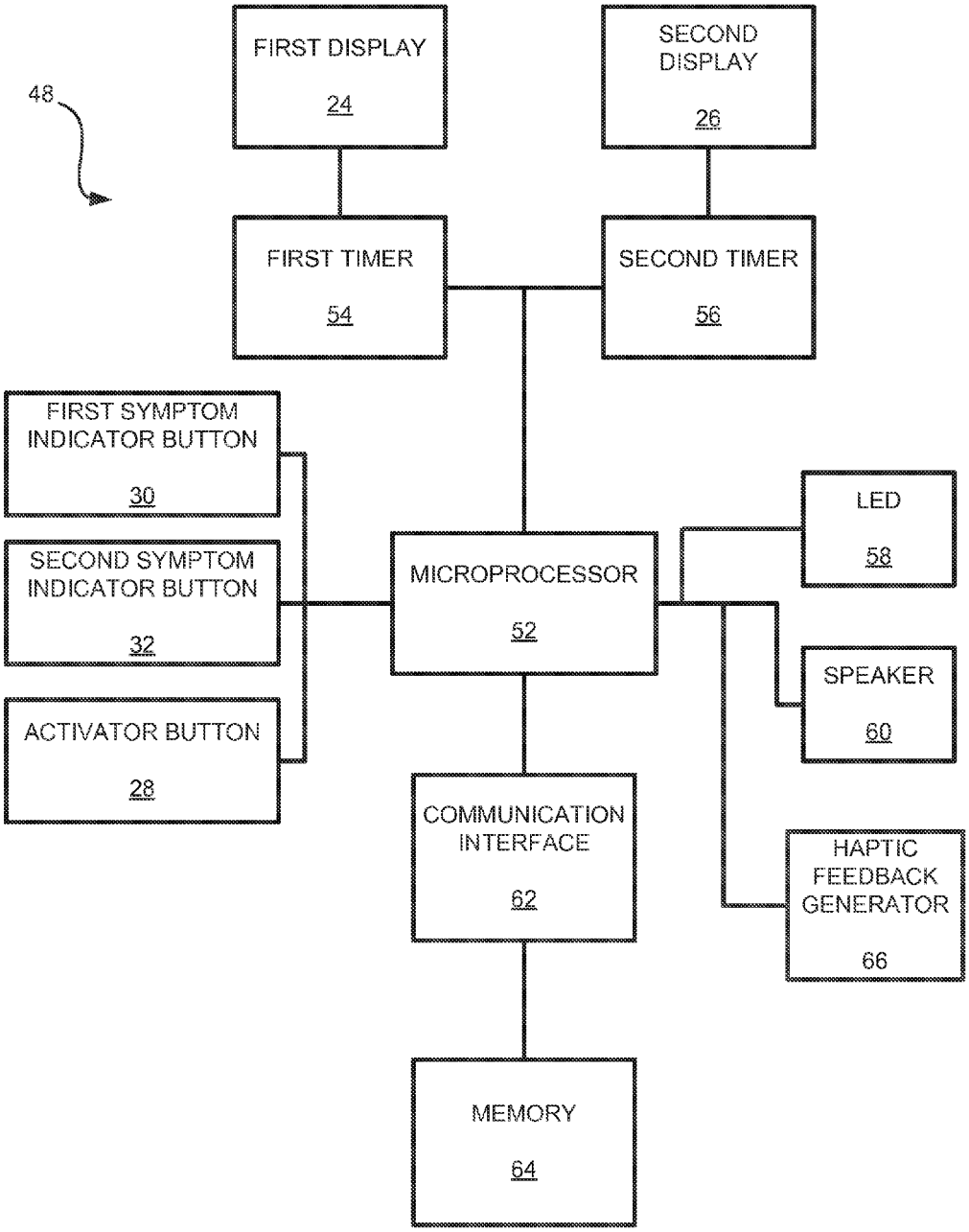
FIG. 4 is a schematic diagram of the logic board used in the device of FIG. 1.

Referring now to FIG. 4, the logic board 48 provides the functionality for displaying since last dose and time since last presentation of a particular symptom in the first display 24 and second display 26, respectively. The logic board 48 is preferably a printed circuit board including a microprocessor 52 generating a clock signal, a first timer 54 for measuring an elapsed time since the last dose of medication was administered, and a second timer 56 for measuring an elapsed time since the particular symptom was last presented. Additionally, the logic board 48 optionally includes one or more light emitting diodes (LEDs) 58, a speaker 60, and/or a haptic feedback generator 66, as well as one or more communication interfaces 62 and a memory 64.

The first timer 54 is electrically connected to the microprocessor 52 for receiving at least a clock signal and a reset signal. The first timer 54 uses the input clock signal to measure an elapsed time since an immediately previous medication dose was administered. For example, the clock signal connected to the first timer 54 optionally causes the timer to measure elapsed time in increments of hours, tenths of an hour, minutes, or other time increments meaningful for measuring the elapsed time since the last medication dose was administered, which is triggered by the depression of the activation button 28. The microprocessor 52 also selectively provides a reset signal to the first timer 54, which is used to reset the timer to zero. In one embodiment, the reset signal is generated in response to a user depressing the activation button 28. However, other actions for resetting the first timer 54 are contemplated, such as pressing and holding the activation button 28 or simultaneous depressing first and second symptom indicator buttons 30, 32.

The first display 24 is operatively connected to the first timer 54, and displays the value maintained by the first timer. The display 24 is preferably a relatively low-power display, such as a liquid crystal display, a light emitting diode (LED) display, an e-ink display, or the like. The first display 24 may be formed integrally with the first timer 54, or may be a separate element electrically connected to the timer via, for example, electrically conductive wiring.

The second timer 56 is also electrically connected to the microprocessor 52 to receive at least a clock signal and a reset signal. The clock signal provided to the second timer 56 may be the same as the clock signal provided to the first timer 54, or a separate signal. The second timer 56 uses the input clock signal for measuring an elapsed time since a particular symptom presented in a user. For example, the second timer may measure time in increments of hours, days, tenths of a day, weeks, or any other regular time unit useful for providing information to a user. The reset signal is preferably provided to the second timer 56 when the first symptom indicator button 30 is depressed by a user.

The second display 26 is electrically connected to the second timer 56 such that the value of the second timer is displayed on the second display. The second display 26 is preferably selected to match the first display 24. As is the case with the first display 24, the second display 26 may be formed integrally with the second timer 56, or may be a separate element electrically connected to the timer by electrically conductive wiring.

The one or more LEDs 58 are optionally disposed within the body 12 so that the LEDs illuminate at least a portion of the activation button 28, the beveled ring 50, the first display 24, and/or the second display 26. When a user depresses the activation button 28 (i.e., when the user properly activates the medication in the first vial 20), the first timer 54 is preferably reset as discussed above. In addition, depressing the button 28 preferably causes the microprocessor 52 to provide an electrical signal to one or more of the LEDs 58, the speaker 60, and/or the haptic feedback generator 66, causing a visual, audio, and/or tactile cue to be emitted from the device 10. These visual, audio, and/or tactile cues are designed to be pleasing to the user and thus provide positive reinforcement for proper use of the device 10.

Additionally, any or all of the one or more LEDs 58 are optionally illuminated at particular times. For example, the LEDs 58 may be illuminated after the first timer measures that a set amount of time has elapsed (i.e., a particular amount of time has passed since the last medication dose was administered). This serves, for an example, as a reminder that the use is due to administer another dose of the medication. In addition to or in place of illumination of the one or more LEDs 58 at these particular times, an audible tone may be emitted from the speaker 60, and/or a tactile cue may be created by the haptic feedback generator 66. Further, any or all of the LEDs 58 are optionally illuminated for a particular amount of time immediately following depression of the activation button 28. This may serve to indicate the length of time a user should perform the steps of medication activation.

Similarly, in response to a user depressing the second symptom indicator button 30, indicating that a symptom has not been present since the last use of the device 10, the microprocessor 52 transmits a signal to one or more of the LEDs 58, the speaker 60, and/or the haptic feedback generator 66, resulting in an audio, visual, and/or tactile display (e.g., one or more of a flashing LED, an audio tone or series of tones emitted from the speaker, and a tactile cue produced by the haptic feedback generator). This audio, visual, and/or tactile cue is intended to instill a sense of accomplishment in the user, and to offset any negative feelings associated with administration of the medication.

Additionally, the device 10 optionally includes one or more communication interfaces 62. For example, the device 10 may include a radio-frequency identification (RFID) reader capable of reading data from an RFID tag optionally included on the medication container 16 during the medication activation. The data is then stored within the memory 64.

The memory 64 is preferably a non-transitory computer readable medium, such as a random access memory, flash memory, a magnetic or magneto-optical memory, or the like. An additional wired or wireless communication interface 62 such as a serial port, parallel port, universal serial bus (USB), local area network (i.e., IEEE 802.3 specification or similar), wireless local area network (i.e., IEEE 802.11a/b/g/n/ac specification or similar), Bluetooth (per IEEE 802.15.1 specification or similar), or the like is optionally included on the logic board 48 for retrieving the data stored in the memory 64.

The elements of the logic board 48 are powered by a power source, such as a battery, such as a replaceable or non-replaceable alkaline battery. Preferably, battery capacity provides power to the logic board 48 for a period of time that greatly exceeds a meaningful patient goal for the outcome timer 56, such as 1 year. Alternatively, a rechargeable power source (e.g., a nickel metal hydride battery, lithium ion battery, or lithium polymer battery) or a renewable power source (e.g., a photovoltaic panel) is used to power the elements of the logic board 48.

Figure 5:
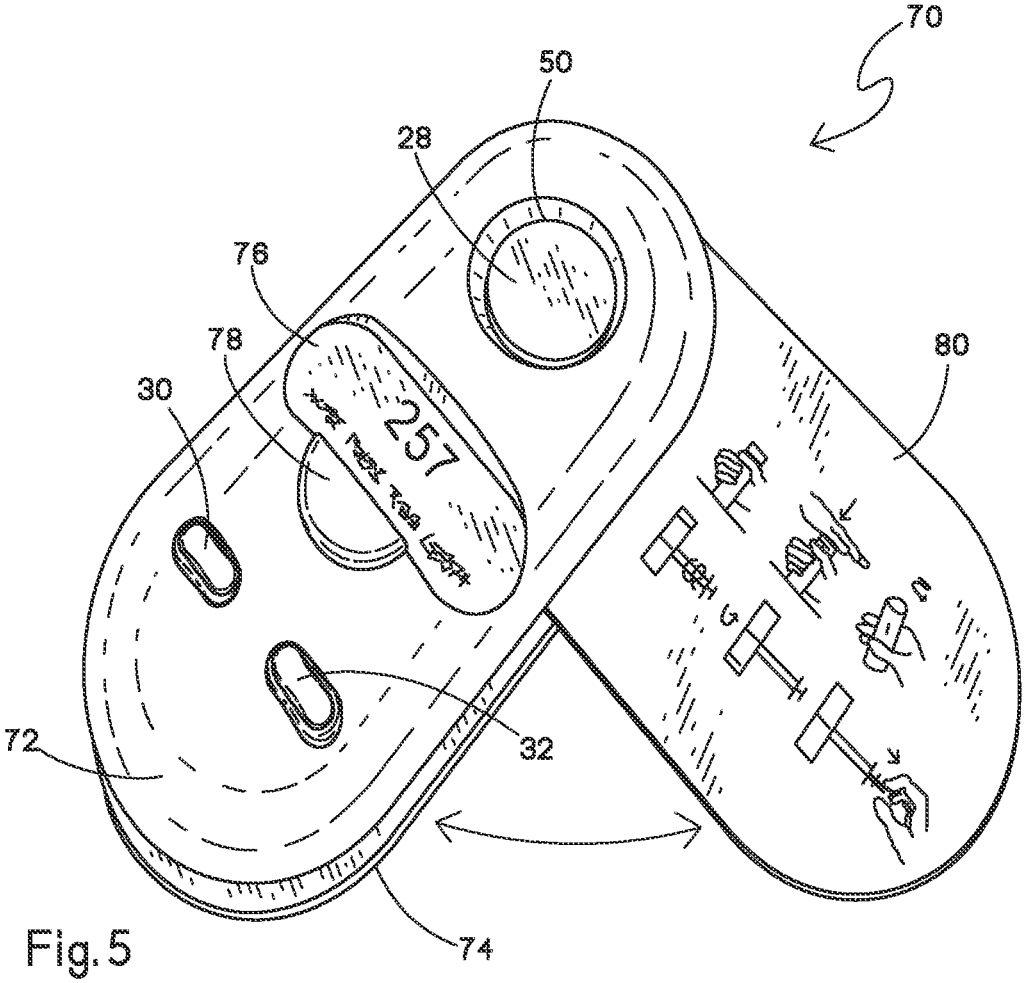
FIG. 5 is a perspective view of another embodiment of the present device including a pocket formed in the main body and a leaflet stored in the pocket.

Referring now to FIG. 5, another embodiment of the present device for encouraging patient compliance with a medication schedule and administration technique is generally designated 70. The device 70 is consistent in many respects to the device 10, and shared components are indicated with identical reference numbers. The device 70 includes a main body 72 that defines an elongate, slot-like cavity 74. Disposed on the main body 72 are an activator button 28, a beveled ring 50 and first and second symptom indicator buttons 30, 32. Also disposed on the main body 72 are a multifunction display 76 and a toggle button 78.

The cavity 74 is sized to retain at least one instruction panel 80 which includes printed material as described above. In the preferred embodiment, the panel 80 is formed as a series of one or more sub-panels that are pivotably retained within the cavity 74. Pivoting action occurs about a point approximately coaxial with the activation button 28. Thus, the cavity 74 accommodates a pivoting action of the panel 80 under user control from a concealed position within the cavity and an exposed position, as seen in FIG. 5. When the instructions are no longer needed, they can be concealed within the cavity 74.

The multifunction display 76 is operatively connected to both the first timer 54 and the second timer 56, and is thus capable of displaying the elapsed time measured by each timer, together with a brief text label. For example, the display includes both an elapsed time measured by the second counter and the text label "days since my last bleed". The user operates the toggle button 78 to toggle between at least a first display function displaying the elapsed time measured by the first timer 54 and a first display label, and a second display function displaying the elapsed time measured by the second timer 56 and a second display label. Further, additional display functions are contemplated. For example, a clock display function displaying a current time is optionally included.

While the principles of the present device to encourage adherence to medication schedules and proper administration techniques have been described above in connection with specific apparatus and applications, it is to be understood that this description is made only by way of example and not as a limitation on the scope of the claims following below.

The invention claimed is:

1. A method of using a device for encouraging adherence to a medication schedule and proper administration technique, comprising:

placing the device on a surface, the device including;

a body;

a first timer associated with said body for measuring and displaying an elapsed time since an immediately prior medication dose was administered;

a first button on said body that, when depressed relative to said body, resets said first timer, said first button being sized and shaped for accommodating a medication container used to store or activate the medication;

said first button and said body are configured for cooperating with the medication container for facilitating mixing of the medication;

engaging the medication container with said first button and resetting said first timer; and the device further comprises a second timer associated with said body, said second timer configured for measuring and displaying an elapsed time since a particular symptom presented in a user; and at least a second button disposed on said body and configured for at least one of updating and resetting said second timer.

2. The method according to claim 1, wherein the engaging the medication container includes depressing said first button, and wherein said body and said first button define a recess for accommodating the medicine container and depressing said first button includes at least one step in a reconstitution of a lyophilized medication simultaneously with resetting of said first timer.

3. The method of claim 1, wherein the device further comprises a microprocessor operatively connected to said first timer, said microprocessor configured for generating a clock signal, wherein said first timer receives the generated clock signal as an input for measuring the elapsed time.

4. The method of claim 1, further comprising at least one notification device selected from the group consisting of a light emitting diode and a speaker, and wherein said at least one notification device provides an audio and/or visual output in response to activation of the button.

5. The method of claim 4, the device further comprising a third button for activating said at least one notification device.

6. The method of claim 1, the device further comprising a cover connected to said body and configured for covering at least a portion of said body.

7. The method of claim 6, wherein said cover includes a pocket configured for removably retaining a printed leaflet containing information related to at least one of the device and the medication.

8. The method of claim 1, wherein at least one of said first and second timers include a liquid crystal display for displaying the elapsed time.

9. The method of claim 1, wherein said body includes a cavity accommodating a pivoting portion being movable under user control from a concealed portion within said cavity and an exposed position.

10. The method of claim 1, wherein the engaging the medication container includes depressing said button, and wherein said body and said first button define a recess for accommodating the medicine container and depressing said first button includes at least one step in a reconstitution of a lyophilized medication simultaneously with resetting of said first timer.

11. The method of claim 1, further comprising a microprocessor operatively connected to said timer, said microprocessor configured for generating a clock signal, wherein said timer receives the generated clock signal as an input for measuring the elapsed time.

12. The method of claim 1, further comprising at least one notification device selected from the group consisting of a light emitting diode and a speaker, and wherein said at least one notification device provides an audio and/or visual output in response to activation of the button.

13. The method of claim 1, wherein said body includes a cavity accommodating a pivoting portion being movable under user control from a concealed portion within said cavity and an exposed position.

14. A device for encouraging adherence to a medication schedule and proper administration technique, comprising:

a body;

a microprocessor disposed within said body and configured for generating at least one clock signal;

a first timer associated with said body, said first timer receiving, as an input, one said at least one clock signal generated by said microprocessor, and being configured for measuring and displaying a time elapsed since an immediately prior medication dose was administered on the basis of the input clock signal;

a second timer associated with said body, said second timer receiving, as an input, one said at least one clock signal generated by said microprocessor, and being configured for measuring and displaying an elapsed time since a particular symptom presented in a user on the basis of the input clock signal;

a first button on said body that, when depressed relative to said body, resets said first timer, said first button being sized and shaped for accommodating a medication container used to store or activate the medication; and a second button for resetting said second timer, wherein said first button is constructed and arranged for cooperating with the medication container for mixing the medication.

15. The device of claim 14, wherein the medication container is used to depress said button, and wherein said body and said button define a recessed space for accommodating the medicine container such that depressing said button using the medication container causes reconstitution of a lyophilized medication simultaneously with resetting of said first timer.

16. The device of claim 14, wherein the clock signal received by the first timer and the clock signal received by the second timer are identical.

17. The device of claim 14, further comprising at least one notification device selected from the group consisting of a light emitting diode and a speaker, and wherein said at least one notification device provides an audio and/or visual output in response to activation of the button; and a first communication interface configured for reading data associated with the medication container; a memory for storing the read data; and a second communication interface configured for transferring the stored data; and a multifunction display disposed on said body and operatively connected to said first timer and said second timer; and a toggle button disposed on said body, said toggle button configured for causing said multifunction display to selectively display one of the elapsed time measured by said first timer and the elapsed time measured by said second timer.

18. A medication administering system, comprising:

a medication container including a plurality of components held separated by said container; and a device for encouraging adherence to a medication schedule and proper administration technique, the device including:

a body;

a first timer associated with said body for measuring and displaying an elapsed time since an immediately prior medication dose was administered;

a first button on said body that, when depressed relative to said body, resets said first timer, said button being sized and shaped for accommodating said medication container used to store or activate the medication; and a second timer associated with said body, said second timer configured for measuring and displaying an elapsed time since a particular symptom presented in a user; and at least a second button disposed on said body and configured for at least one of updating and resetting said second timer wherein said medication container is used to depress said first button, thereby allowing mechanical breach of partitions separating the components.

* * * * *